US012638262B2

(12) United States Patent
McNeil

(10) Patent No.: US 12,638,262 B2
(45) Date of Patent: May 26, 2026

(54) CROSSBOW BOLT RETENTION PLUNGER

(71) Applicant: KILLER INSTINCT, INC., Milwaukee, WI (US)

(72) Inventor: David McNeil, Grant, MI (US)

(73) Assignee: Killer Instinct, Inc., Frankenmuth, MI (US)

( * ) Notice: Subject to any disclaimer, the term of this patent is extended or adjusted under 35 U.S.C. 154(b) by 164 days.

(21) Appl. No.: 18/756,477

(22) Filed: Jun. 27, 2024

(65) Prior Publication Data

US 2026/0002754 A1 Jan. 1, 2026

(51) Int. Cl.
*F41B 5/12* (2006.01)
*F41B 5/14* (2006.01)

(52) U.S. Cl.
CPC ..... *F41B 5/123* (2013.01); *F41B 5/1469* (2013.01); *F41B 5/1426* (2013.01); *F41B 5/143* (2013.01)

(58) Field of Classification Search
CPC ..... F41B 5/123; F41B 5/1469; F41B 5/1426; F41B 5/143; F41B 5/12
See application file for complete search history.

(56) References Cited

U.S. PATENT DOCUMENTS 4,722,318 A 2/1988 Yankey
5,884,614 A 3/1999 Darlington et al.
6,802,304 B1 * 10/2004 Chang ..... F41B 5/123 124/40
7,455,059 B2 11/2008 Shaffer
7,588,022 B2 * 9/2009 Chang ..... F41B 5/123 124/40
8,662,061 B1 3/2014 Darlington et al.
8,931,465 B1 * 1/2015 Choma ..... F41B 5/12 124/40
9,004,053 B1 4/2015 Anderson
9,097,485 B2 8/2015 Lipowski
9,121,659 B1 * 9/2015 Chang ..... F41B 5/123
9,140,516 B1 9/2015 Hyde
9,255,755 B1 * 2/2016 Barnett ..... F41B 5/14
9,417,029 B1 * 8/2016 Chang ..... F41B 5/1469
9,726,454 B2 8/2017 McPherson et al.
10,209,027 B2 * 2/2019 Chu ..... F41B 5/12
10,254,073 B2 * 4/2019 Yehle ..... F41B 5/143
10,401,117 B1 * 9/2019 Rowzie, Jr. ..... F41A 19/06
10,962,322 B2 * 3/2021 Yehle ..... F41B 5/066
11,512,923 B2 11/2022 Trpkovski
11,549,778 B1 * 1/2023 Liu ..... F41B 5/143
(Continued)

*Primary Examiner* — Joshua E Freeman
(74) *Attorney, Agent, or Firm* — Warner Norcross + Judd LLP

(57) ABSTRACT

A crossbow can include a bolt retention plunger configured to retain a bolt against a rail of a crossbow. The bolt retention plunger can be movable between a retention mode and a neutral mode and can be operable in the retention mode to engage a bolt to consistently and evenly hold it adjacent the rail. The bolt retention plunger can define a planar surface facing the rail. The planar surface can contact the bolt along a linear line of tangency, rather than a point, extending parallel to a longitudinal axis of the bolt. The crossbow can include a safety extending in the receiver and an anti-dry fire element movably disposed in the receiver. The bolt retention plunger can be separately operable from and distal from the anti-dry fire element and the safety.

20 Claims, 9 Drawing Sheets

(56) References Cited

U.S. PATENT DOCUMENTS

| | | | | |
|---|---|---|---|---|
| 11,629,943 | B2 * | 4/2023 | Langdon | F41B 5/123 473/578 |
| 11,703,299 | B1 * | 7/2023 | Chang | F41G 11/003 124/25 |
| 11,768,052 | B2 | 9/2023 | Barnett | |
| 11,808,544 | B1 * | 11/2023 | Chu | F41B 5/1469 |
| 12,449,224 | B2 * | 10/2025 | Yehle | F41B 5/10 |
| 2013/0098343 | A1 | 4/2013 | Grace | |
| 2013/0291847 | A1 | 11/2013 | Darlington | |
| 2016/0252320 | A1 * | 9/2016 | Kinmont, Jr. | F41B 5/12 124/25 |
| 2017/0160044 | A1 * | 6/2017 | Khoshnood | F41B 5/12 |
| 2018/0094895 | A1 * | 4/2018 | Yehle | F41B 5/066 |
| 2018/0172394 | A1 * | 6/2018 | Trpkovski | F41B 5/1426 |
| 2018/0187996 | A1 * | 7/2018 | Yehle | F42B 6/08 |
| 2022/0341717 | A1 * | 10/2022 | Langdon | F41B 5/12 |
| 2022/0364820 | A1 * | 11/2022 | Barnett | F41B 5/1461 |
| 2023/0168062 | A1 * | 6/2023 | Yehle | F41B 5/105 124/25 |
| 2024/0011732 | A1 | 1/2024 | Egerdee et al. | |

* cited by examiner

CROSSBOW BOLT RETENTION PLUNGER

BACKGROUND OF THE INVENTION

The present invention relates to archery crossbows, and more particularly to bolt retention features for crossbows.

Crossbows have been used throughout the centuries for hunting, fishing, and target shooting. Crossbows typically include a stock joined with a rail, upon which a bolt or an arrow is placed. A pair of bow limbs are mounted at an end of the rail and a bowstring is strung between the limbs over the rail for engagement with the bolt or arrow. Sometimes, the crossbow includes cams on the bow limbs that receive the bowstring and one or more power cables to increase stored energy. Most crossbows also include a trigger mechanism adjacent the rail operable to hold the bowstring in a drawn configuration and to release the bowstring to fire the crossbow, thereby shooting an arrow or bolt from the crossbow.

After a crossbow is drawn, an arrow or bolt typically is loaded on the rail and engaged with the bowstring, readying the bolt for later firing from the crossbow. The bolt is usually retained against the rail with a bolt retention system. Bolt retention is helpful when the crossbow is being transported to and from a hunting or shooting location, to prevent the bolt from falling out of the crossbow and becoming lost or posing a hazard to the user and others. The retention system also can retain the bolt relative to the crossbow while a user is in a hunting tree stand or ground blind, so that the bolt does not become disengaged from the bowstring, possibly creating a potential dry fire condition or loss of the bolt.

Two common types of bolt retention systems are roller retainers and bristle retainers. Roller retainers typically include one or more ball bearings that contact a shaft of the bolt at discrete points and exert a force on the bolt to ensure the bolt is retained against the rail of the crossbow. An issue with roller retainers is that they only provide point contact with the bolt, and by their nature, will roll when urged to do so. Thus, when a bolt retained by a roller retainer is under the force of gravity, the retaining roller can roll, as they are designed to do, and allow the bolt to slide along the rail and/or fall out of the crossbow, defeating the purpose of retaining the bolt. Bristle retainers include flexible bristles that contact the bolt and retain the bolt against the rail. An issue with bristle retainers, however, is that the bristles might part or separate to engage the bolt inconsistently, which can produce inconsistent forces on the bolt and thereby affect its travel along the rail and subsequent trajectory after the bolt leaves the crossbow. Bristles also can wear out over time, which can affect their consistent engagement with the bolt, and thus trajectory of the bolt when shot from the crossbow.

Accordingly, there remains room for improvement in the field of crossbows, and in particular systems and components to facilitate effective retention of crossbow bolts.

SUMMARY OF THE INVENTION

A crossbow is provided including a bolt retention plunger configured to capture a bolt relative to a rail of the crossbow and force the bolt against the rail.

In one embodiment, the crossbow can include a receiver joined with the frame, and a bowstring catch configured to maintain the bowstring in a drawn mode. The bolt retention plunger can be disposed adjacent the bowstring catch. The bolt retention plunger can be movable among and between a retention mode and a neutral mode. In the retention mode, the bolt retention plunger is operable to engage a bolt disposed adjacent the rail.

In another embodiment, the bolt retention plunger can define a planar surface facing the rail. The planar surface can be configured to engage a bolt at least partially disposed in the receiver along a line of tangency in the retention mode. The line of tangency can extend parallel to a longitudinal axis of the bolt.

In yet another embodiment, the bolt retention plunger can exert an evenly distributed and centered downward force via the line of contact to the bolt. In turn, this can provide a consistent and centered force on the bolt, which is translated evenly to the rail on which the bolt can be disposed.

In still another embodiment, the crossbow can include a first tunable fastener disposed in a first aperture defined by the receiver and a first biasing element disposed between the first tunable fastener and the bolt retention plunger. The first tunable fastener can be adjustable to exert a predetermined first force on the first biasing element. The first force can be transferred through the first biasing element to the bolt retention plunger and subsequently against the bolt to hold the bolt against the rail.

In yet another embodiment, the crossbow can include a first tunable fastener disposed in a first aperture defined by the receiver and a second tunable fastener disposed in a second aperture defined by the receiver. The second aperture can be distal and rearward from the first aperture. A first biasing element can be disposed between the first tunable fastener and the bolt retention plunger, and a second biasing element can be disposed between the second tunable fastener and the bolt retention plunger.

In still another embodiment, the first tunable fastener can be adjustable to exert a first force on the first biasing element. The first force can be transferred through the first biasing element to the bolt retention plunger. The second tunable fastener can be likewise adjustable to exert a second force on the second biasing element. The second force can be transferred through the second biasing element to the bolt retention plunger distal and rearward from the first force.

In yet another embodiment, the first tunable fastener and the second tunable fastener can be selectively and independently adjusted to exert equal and/or unequal forces on the bolt retention plunger, to thus exert such forces on the bolt. For example, the fore to aft forces exerted on the plunger and thus the bolt can increase fore to aft, decrease fore to aft, be equal fore to aft, or in some other force distribution.

In even another embodiment, the first tunable fastener can be a first threaded set screw and the second tunable fastener is a second threaded set screw. The first biasing element can be a first compression spring. The second biasing element can be a second compression spring. The first compression spring can be located below the first tunable fastener and in a first well defined by the bolt retention plunger. The second compression spring can be located below the second tunable fastener and in a second well defined by the bolt retention plunger rearward of the first well.

In a further embodiment, the receiver can be fixed or moveable relative to a frame or stock of the crossbow. Where the receiver is moveable, it can be movable along the frame from a first position adjacent the first limb and the second limb in the undrawn mode to a second position distal from the first limb and the second limb in the drawn mode. In an alternative embodiment, the receiver can be stationary and fixed relative to the frame, that is, the receiver is not movable along the frame.

In still a further embodiment, the bolt retention plunger can be disposed within a plunger chamber defined by a receiver. The plunger chamber can be disposed over a bolt void defined by the receiver and configured to receive a bolt. The bolt retention plunger can be configured to be biased farther into the plunger chamber when the bolt is placed in the bolt void.

In yet a further embodiment, the bolt retention plunger can include a first arm and a second arm. The first arm can include a first tab, and the second arm can include a second tab. The receiver can include a chamber wall that bisects the plunger chamber into a first arm chamber and a second arm chamber. The receiver can include a first retaining step and a second retaining step disposed proximate an opening of the plunger chamber. The first arm can be disposed within the first arm chamber and the second arm can be disposed within the second arm chamber. The first tab can be operable in the neutral mode to contact the first retaining step and the second tab can be operable in the neutral mode to contact the second retaining step, thereby retaining the bolt retention plunger in the plunger chamber.

In even a further embodiment, the first arm can define a first well and the second arm can define a second well. The first biasing element can be disposed within the first well and the second biasing element can be disposed within the second well.

In another embodiment, the bolt retention plunger can define a chamfered edge or an angled forward ramp that is configured to first engage the bolt when the bolt engages the bolt retention plunger. The chamfered edge can be disposed on a forward end of the bolt retention plunger.

In still another embodiment, the crossbow can include a safety extending in the receiver and an anti-dry fire element movably disposed in the receiver. The bolt retention plunger can be separately operable from, disconnected from and distal from the anti-dry fire element and the safety.

In yet another embodiment, the first tunable fastener can be a first threaded set screw, and the first biasing element can be a coil spring. The coil spring can be disposed in a first well defined by the bolt retention plunger. The planar surface of the bolt retention plunger can transition to an angled forward ramp. The angled forward ramp can be configured to first engage the bolt when the bolt engages the bolt retention plunger. The planar surface can engage the line of tangency along a portion of the bolt having a length of 1 mm to 30 mm.

The current embodiments provide a crossbow for effectively and safely retaining a bolt or arrow within a crossbow, and for consistently engaging and holding the bolt or arrow with evenly distributed forces.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

Figure 1:
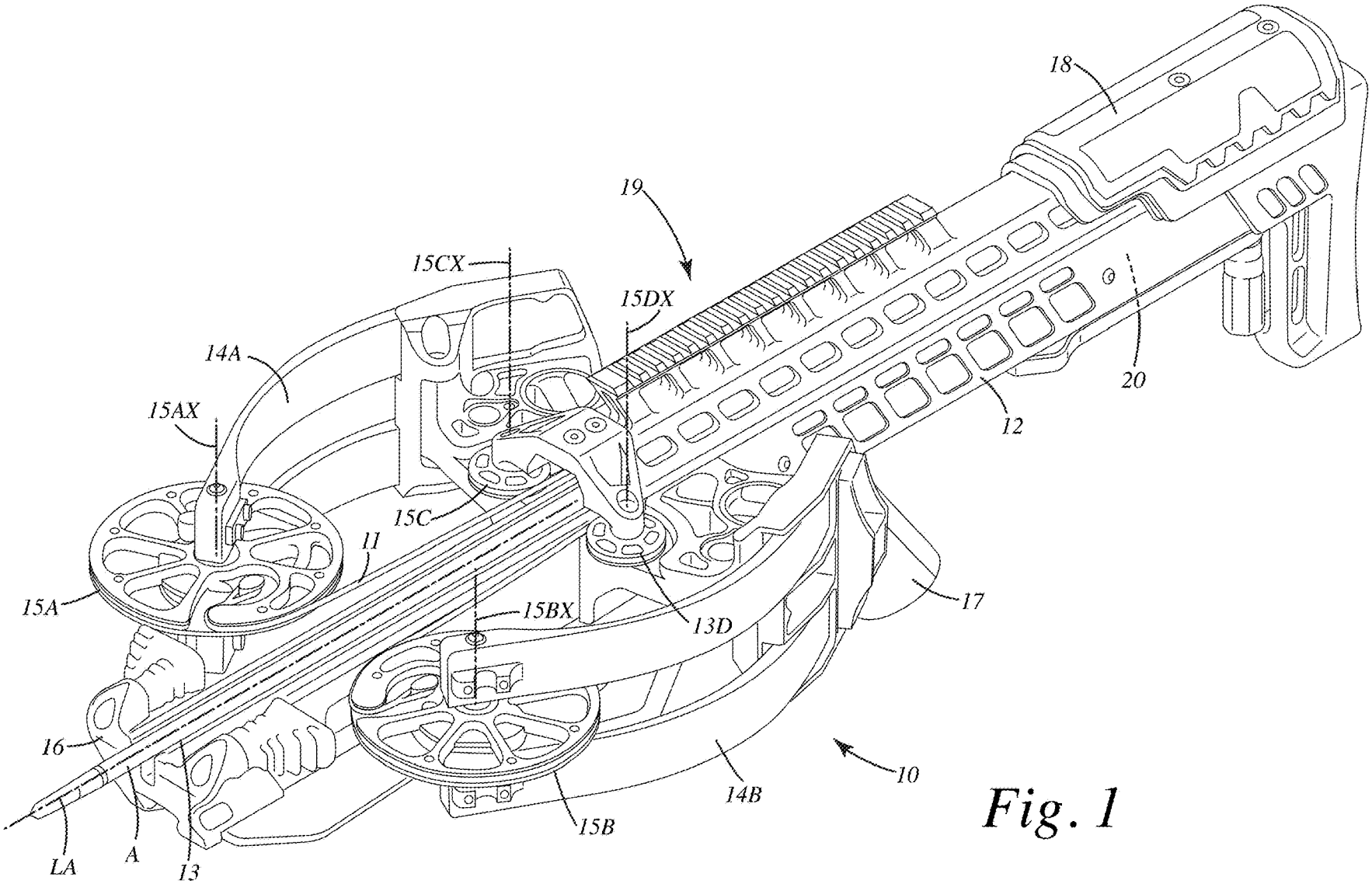
FIG. 1 is a perspective view of the crossbow of a current embodiment.
Figure 2:
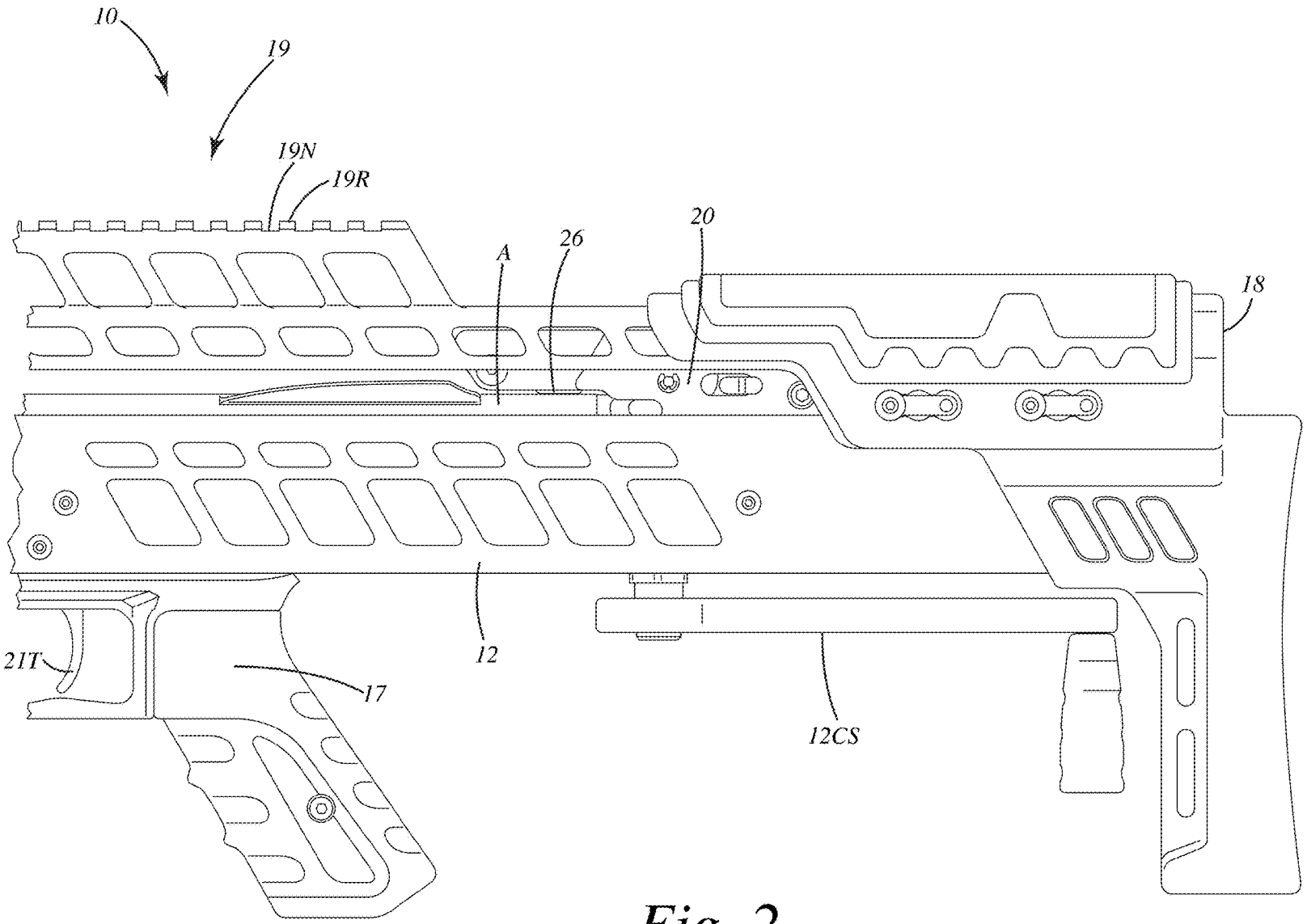
FIG. 2 is a close-up side view of the crossbow including a receiver disposed on a frame of the crossbow.

A current embodiment of the crossbow including a trigger assembly with a bolt retention plunger is shown in FIGS. 1-9 and generally designated 10. The crossbow 10 shown in FIG. 1 is shown as an archery crossbow. It will be appreciated that the crossbow 10 with the receiver with the bolt retention plunger as described herein can be used with any type of projectile shooting device that uses or shoots an arrow, bolt, or other projectile. As used herein an arrow can refer to an arrow, a bolt or some other elongated projectile. As generally shown in FIG. 1, the crossbow 10 is shown with its bowstring 11 in a drawn mode, held in place by a receiver 20 that can be mounted within a barrel or frame 12 of the crossbow 10. The disposition of the receiver 20 within the crossbow 10 is shown in FIG. 2. The bowstring 11 can be selectively released via the receiver 20 to shoot the arrow A from the crossbow 10. As the crossbow 10 transitions and the bowstring 11 moves from the drawn mode shown in FIG. 1, to an undrawn mode or released mode, which are used interchangeably herein, the bowstring 11 moves forward until it extends generally perpendicular to the frame 12 and the rail 13 upon which the arrow A rests or moves as it is propelled by the bowstring 11.

As shown in FIGS. 1 and 2, the crossbow 10 can include a first limb 14A and a second opposing limb 14B disposed on opposite sides of the barrel or frame 12 and the rail 13. To each of these respective limbs 14A and 14B, respective cams 15A and 15B can be joined. These cams 15A and 15B can be any type of cam, pulley, disc and/or round or oval member capable of rotating about the respective axes 15AX and 15BX. To these respective cams, the bowstring 11 can be joined and journaled in respective tracks of the cams. The bowstring 11 generally can unwind or unfurl from the respective cams on opposing sides of the frame 12 when moving from an undrawn mode, also referred to as a released mode herein, to a drawn mode or cocked mode as shown in FIG. 1. Generally, the bowstring 11 can extend transverse to the frame 12 and rail 13, between the respective cams in most if not all of these modes. Further, power cables (not shown) can be joined with and extend from one cam to the other cam to transfer energy stored in the limbs 14A and 14B in a conventional manner to the bowstring 11 to shoot the bolt or arrow A from the crossbow 10.

Figure 3:
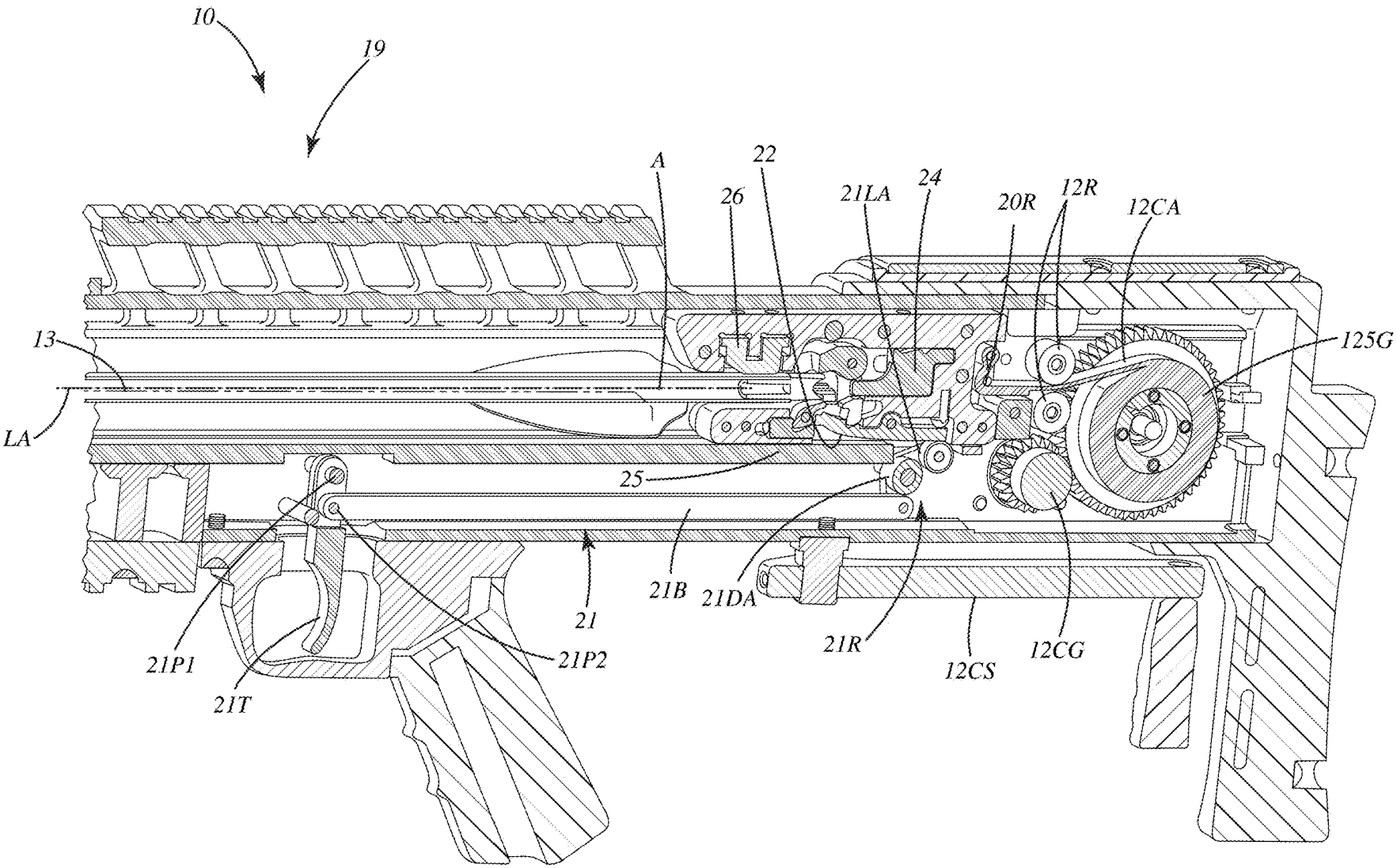
FIG. 3 is a partial section side view of the crossbow including a receiver including a trigger assembly, a safety, and a bolt retention plunger in a retention mode to retain a bolt.

The crossbow 10, as mentioned above, can include the barrel or frame 12 which can extend rearwardly from a riser 16 of the crossbow 10. An optional stirrup (not shown) can be joined with the riser 16 and/or the frame 12 to allow a user to stabilize the crossbow 10 as it is drawn as described below. Limbs 14A and 14B can be fastened or secured to the riser 16 and/or the frame 12. The barrel or frame 12 can extend rearward from the riser 16 and/or can be integral with the riser 16 and/or the limbs depending on the configuration of the same. The frame 12 can include an internal compartment as shown in FIG. 3. This internal compartment can house a gear system described below. The frame 12 can include and/or can be joined with a grip 17, which as shown can extend downward from the frame 12 generally between the riser 16 and a stock 18 that can be secured to the rearward portion of the frame 12. The grip 17 can be in the form of a pistol grip and ergonomically configured to receive a user's hand allowing the user to grip, manipulate, hold and/or steady the crossbow 10 in a variety of configurations.

The frame 12 optionally can include a mounting arm 19. This mounting arm 19 can be joined with the frame 12 directly or joined with a receiver 20 and secured thereto via a system of fasteners. The fasteners can be in the form of screws that are screwed into corresponding threaded holes in the upper portion of the frame 12. The mounting arm can include a forward end 19F and an opposing rearward end 19L closer to the stock 18. The forward end 19F can extend in any cantilevered manner forwardly over the rail 13 and the frame 12. As depicted in FIG. 1, the forward end of the mounting arm 19 may be joined with the limbs 14A and 14B.

Respective cams 15C and 15D may be joined to the limbs 14A and 14B and disposed between the limbs 14A and 14B and the mounting arm. These cams 15C and 15D can be any type of cam, pulley, disc and/or round or oval member capable of rotating about the respective axes 15CX and 15DX. The cams 15C and 15D operate in conjunction with the cams 15A and 15D. To these respective cams, the bowstring 11 can be joined and journaled in respective tracks of the cams. The bowstring 11 generally can unwind or unfurl from the respective cams on opposing sides of the frame 12 when moving from an undrawn mode, also referred to as a released mode herein, to the drawn mode or cocked mode. Generally, the bowstring 11 can extend transverse to the frame 12 and rail 13, between the respective cams in most if not all of these modes.

As shown in FIG. 2, the mounting arm 19 also can include an upper portion of rail 13 that includes multiple ridges 19R and notches 19N. This rail 13 can be in the form of a picatinny or dovetail rail and constructed to receive a sighting device (not shown) such as a scope, reflex sight, red dot or other type of sighting device. The mounting arm 19 as mentioned above can be secured and/or can be integral with the frame 12 at its rearward end.

The receiver 20 can be movable along the frame 12 from a first position adjacent the first limb 14A and the second limb 14B in the undrawn mode to a second position distal from the first limb 14A and the second limb 14B in the drawn mode. Generally, the receiver 20 can be moved from the first position to the second position, and therefore from the undrawn mode to the drawn mode, by a crank system 12S disposed within the internal compartment 12C. The crank system 12S is shown in FIG. 3. FIG. 2 shows the receiver 20 disposed in the second position in the drawn mode. In alternative embodiments, the receiver 20 can be stationary and fixed relative to the frame 12.

Figure 4:
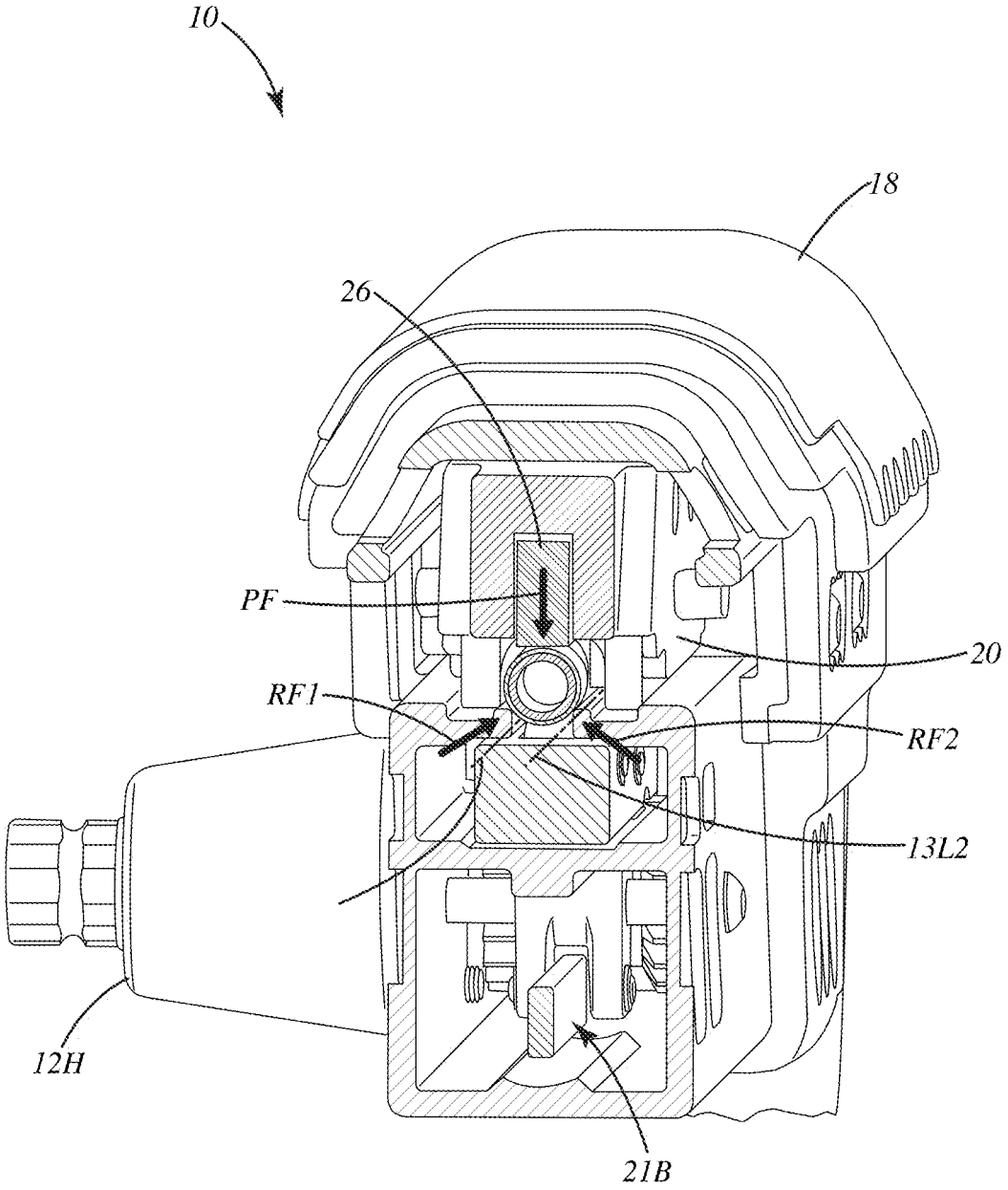
FIG. 4 is a partial section front view of the crossbow including a receiver including a safety and a bolt retention plunger in a retention mode to retain a bolt.
Figure 5:
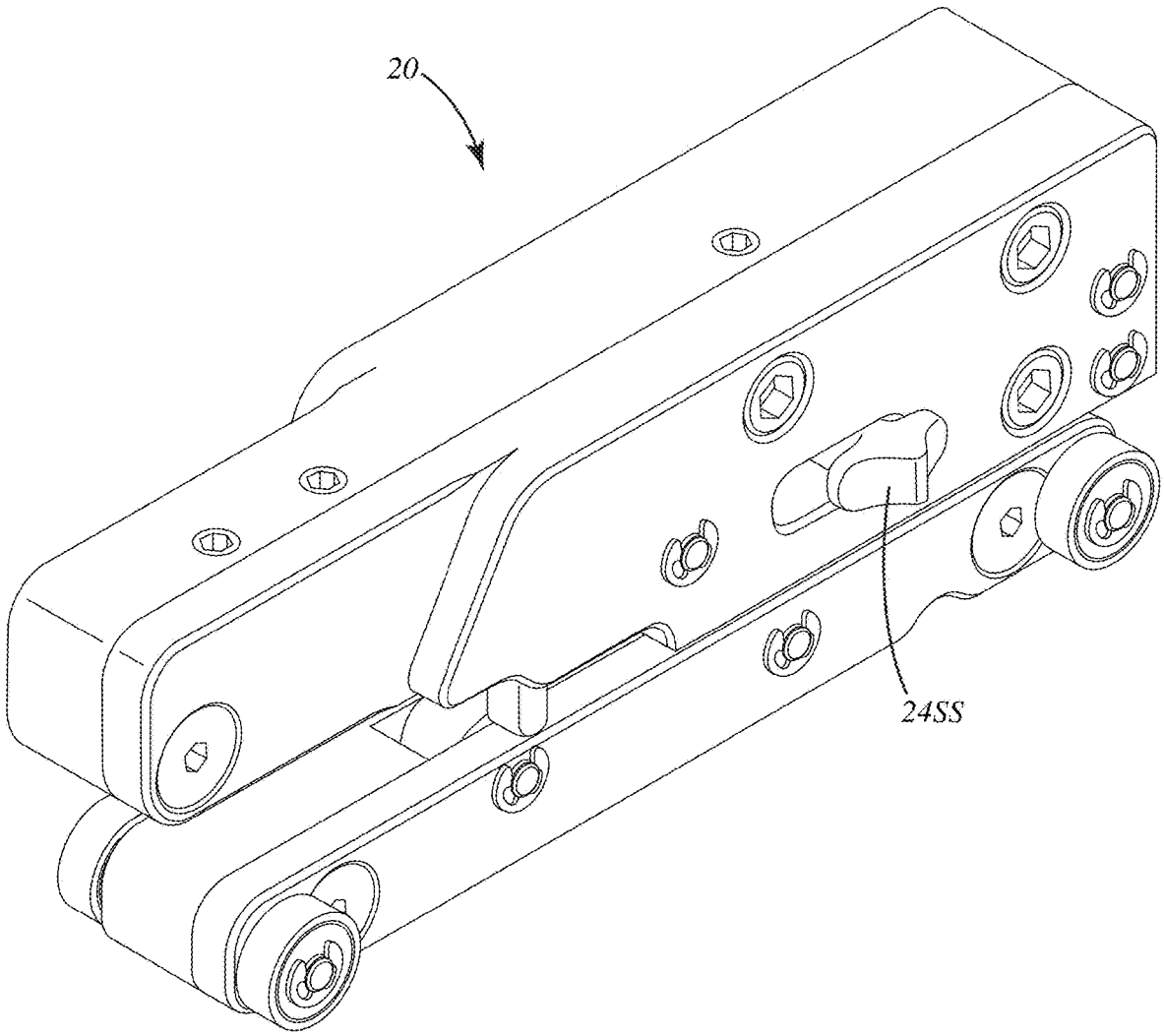
FIG. 5 is a perspective view of a receiver isolated from the crossbow.

As shown in FIG. 2, the crossbow 10 includes a stowable crank shaft 12CS. The crank shaft 12CS can be stowable under the frame 12 and can be couplable with a crank housing 12H disposed on a side of the frame 12. The crank housing 12H is depicted in FIG. 4. The crank housing 12H defines a threaded female adapter couplable with a threaded male adapter of the crank shaft 12CS. The rotation of the crank shaft 12CS within the crank housing 12H rotates a crank gear 12CG of the crank system disposed within the internal compartment, shown in FIG. 3. The crank gear 12CG includes a set of gear teeth that retainably interface or mesh with a set of gear teeth of a spool gear 12SG. The rotation of the crank gear 12CG rotates the spool gear 12SG. A cable 12CA can be disposed about an exterior rim of the spool gear 12SG. The cable 12CA can be disposed between a pair of rollers 12R and retained to one or more retaining rods 20R of the receiver 20. As the spool gear 12SG is rotated, the cable 12CA spools or unspools, depending on the direction of rotation. The spooling of the spool gear 12SG will wrap the cable 12CA about the exterior rim of the spool gear, drawing the attached receiver 20, along with the retained bowstring 11, toward the stock 18 and from the undrawn mode into the drawn mode.

The crossbow 10 can include a trigger assembly 21. The various components of the trigger assembly 21 will be described with reference to FIG. 3. The trigger assembly 21 can include or be coupled to a trigger 21T. The trigger 21T can be adjacent the grip 17 and can extend inward into a portion of the internal compartment 12C defined by the frame 12. The trigger 21T can be joined pivotally with the frame 12 via a pivot pin 21P1. The trigger can include a second pivot pin 21P2 that joins the trigger 21T with a trigger bar 21B. The trigger bar 21B can extend rearward from the trigger 21T and the grip 17 toward the receiver 20. The trigger bar 21B can include a rearward end 21R that couples to a displacement arm 21DA of a relay lever 21R. The relay lever 21R can be pivotably joined to the frame 12 and includes a lever arm 21LA extending from the displacement arm 21DA and contacting a relay arm 22RA of a sear 22 disposed within the receiver 20. Pivoting the trigger 21T displaces the trigger bar 21B rearwardly, further displacing the displacement arm 21DA of the relay lever rearward. The movement of the displacement arm 21DA further pivots the relay lever 21R and presses the lever arm 21LA against the relay arm 22RA of the sear 22. Of course, other constructions can be used to join the trigger 21T and the sear 22 depending on the application.

The crossbow 10 includes a receiver 20. Turning to the receiver 20, its various components will be described with reference to FIGS. 5-7. The receiver 20 is shown isolated from the crossbow 10 in FIG. 5. The receiver 20 can be moveable along the frame 12 from a first position adjacent the first limb 14A and the second limb 14B in the undrawn mode to a second position distal from the first limb 14A and the second limb 14B in the drawn mode. Alternatively, the receiver 20 can be stationary and fixed relative to the frame 12.

The receiver 20 defines a trigger assembly opening on a bottom surface of the receiver 20. The trigger assembly opening allows for the relay lever 21R of the trigger assembly 21 to access and contact the sear 22 and ultimately fire the bolt A. In embodiments where the receiver 20 is stationary and fixed relative to the frame 12, the trigger assembly opening will be disposed over the relay lever 21R in both the undrawn and drawn modes. However, in embodiments where the receiver 20 is movable along the frame 12 from the first position in the undrawn mode to the second position in the drawn mode, the trigger assembly opening will be disposed over the relay lever 21R in the drawn mode, but not in the undrawn mode.

The sear 22 can be selectively rotatable about a pivot pin 22P1 and a corresponding pivot axis. The sear 22 can be disposed above the trigger assembly opening. The sear 22 can include a relay arm 22RA disposed proximate the sear safety pin 24SP. In the drawn mode, the relay arm 22RA can be further proximate the lever arm 21LA of the relay lever 21R. The relay arm 22RA defines a relay surface 22RS facing the relay lever 21R and a safety surface 22SS facing the sear safety pin 24SP. The relay arm 22RA can be disposed between the lever arm 21LA of the relay lever 21R and the sear safety pin 24SP. The relay surface 22RS contacts the lever arm 21LA of the relay lever 21R, and the safety surface 22SS contacts the sear safety pin 24SP.

The sear 22 can further include a catch arm 22CA. The catch arm 22CA can be disposed proximate a catch 23 and an anti-dry fire stopper 25S. The catch arm 22CA defines a catch surface 22CS and a stopper surface 22ST opposite the catch surface 22CS. The catch surface 22CS includes a catch detent 22CD configured to selectively retain a fire edge 23E of the catch 23. The catch 23 contacts the catch surface 22CS of the catch arm 22CA. The catch 23 can be selectively rotatable about a pivot pin 23P1 and a corresponding pivot axis. The catch 23 further includes a bowstring arm 23BA configured to selectively retain a bowstring 11 in the drawn mode. In the drawn mode, the fire edge 23E of the catch 23 contacts the catch detent 22CD, thereby retaining the catch 23 and preventing clockwise rotation of the catch 23.

In the fire mode, rearward displacement of the trigger 21T indirectly and upwardly displaces the lever arm 21LA of the relay lever 21R. The lever arm 21LA in turn displaces the relay arm 22RA of the sear 22 in an upward direction, rotating the sear 22 about the pivot pin 22P1 in a counterclockwise direction and downwardly displacing the catch arm 22CA of the sear 22. The fire edge 23E of the catch 23 disengages from the catch detent 23CD, releasing the bowstring 11, firing the bolt A, and returning the crossbow 10 to the undrawn mode. In the undrawn mode, a bottom edge 23BE of the catch 23 contacts the catch surface 22CS of the sear 22.

The crossbow 10 can also include an anti-dry fire system 25 including an anti-dry fire lever 25L and the anti-dry fire stopper 25S. The anti-dry fire system 25 can be operatively disconnected and distal from the bolt retention plunger 26. The anti-dry fire system 25 can be disposed proximate the catch arm 22CA of the sear 22. The anti-dry fire lever 25L can be selectively rotatable about a pivot pin 25P1 and a corresponding pivot axis. The anti-dry fire lever 25L includes an engagement nose 25N and a deactivation arm 25D extending opposite the engagement nose 25N. The anti-dry fire stopper 25S can be disposed within a stopper chamber 25SC defined by the receiver 20. The anti-dry fire stopper 25S includes a stopper head 25SH and defines a lever interface 25LI contacting and facing the engagement nose 25N of the anti-dry fire lever 25L. The anti-dry fire stopper 25S further defines a stopper well 25W. A stopper biasing element can be disposed within the stopper chamber and stopper well. The stopper biasing element can be a compression spring or a coil spring.

The anti-dry fire system 25 can be operable to prevent the dry fire of the crossbow 10 (i.e., the anti-dry fire system can prevent the release of the bowstring 11 by the catch if no bolt is disposed proximate the rail 13). With no bolt disposed adjacent the rail 13, the deactivation arm 25D protrudes above the rail 13 and the engagement nose 25N rests in the lever interface 25LI such that the stopper 25S can be disposed in an activated position. The stopper head 25SH extends outwardly toward the sear 22 and can be disposed immediately below the catch arm 22CA of the sear 22 such that the stopper surface 22ST of the catch arm 22CA contacts an upper surface of the stopper 25S, thereby preventing the counterclockwise rotation of the sear 22 and the release of the catch 23.

In a retention mode, with a bolt A disposed adjacent the rail 13, the bolt A exerts a downward force on the deactivation arm 25D of the anti-dry fire lever 25L. The anti-dry fire lever 25L can be rotated clockwise such that the engagement nose 25N exerts a force on the anti-dry fire stopper 25S toward the interior of the stopper chamber 25SC. The force displaces the anti-dry fire stopper 25S into the stopper chamber 25SC against a biasing force of the stopper biasing element such that the anti-dry fire stopper 25S can be in a deactivated position. The displacement of the anti-dry fire stopper 25S displaces the stopper head 25SH such that the stopper head 25SH may not be disposed in a path of the sear's rotation and does not obstruct the movement of the catch arm 22CA of the sear 22. With the unobstructed path of rotation, the sear 22 can be free to rotate and release the catch 23 as a restoring force of a catch biasing element 23B acts against the catch 23 and rotates the catch 23 clockwise about the catch pivot pin 23P1, firing the crossbow 11. The removal of the bolt A (e.g., by firing the crossbow) removes the downward force on the deactivation arm 25D, causing the force on the anti-dry fire stopper 25S to cease. The biasing force of the stopper biasing element 25B acts to displace the anti-dry fire stopper 25S from the deactivated position into the activated position.

A safety switch 24SS can be disposed on both sides of the receiver 20. Each safety switch 24SS can be joined with a safety 24 disposed within a safety compartment 24C. The safety 24 can be movable within the safety compartment 24C between a safety mode, pictured in FIGS. 5 and 7, and a fire mode, pictured in FIG. 6. A user can toggle the crossbow 10 between the safety mode and the fire mode by moving the safety switch 24SS rearward or forward. In the embodiment depicted in FIGS. 1-9, the forward position of the safety 24 can be the position of the safety 24 in fire mode, and the rearward position of the safety 24 can be the position of the safety 24 in safety mode. In safety mode, the crossbow 10 cannot fire a bolt, while the crossbow 10 can fire a bolt A in fire mode.

The safety 24 defines an upper surface 24U defining a safety mode detent 24SD and a fire mode detent 24FD. The safety mode detent 24SD can be disposed at a forward position and the fire mode detent 24FD can be disposed at a rearward position. The safety 24 can be retained in the safety mode or the fire mode by a safety retaining ball 24R pressed against the upper surface 24U of the safety 24 by a force exerted by a tunable safety fastener 24F on a safety biasing element contacting the safety retaining ball 24R. The tunable safety fastener 24F can be a safety fastener screw and the safety biasing element can be a safety compression spring or a coil spring.

Figure 6:
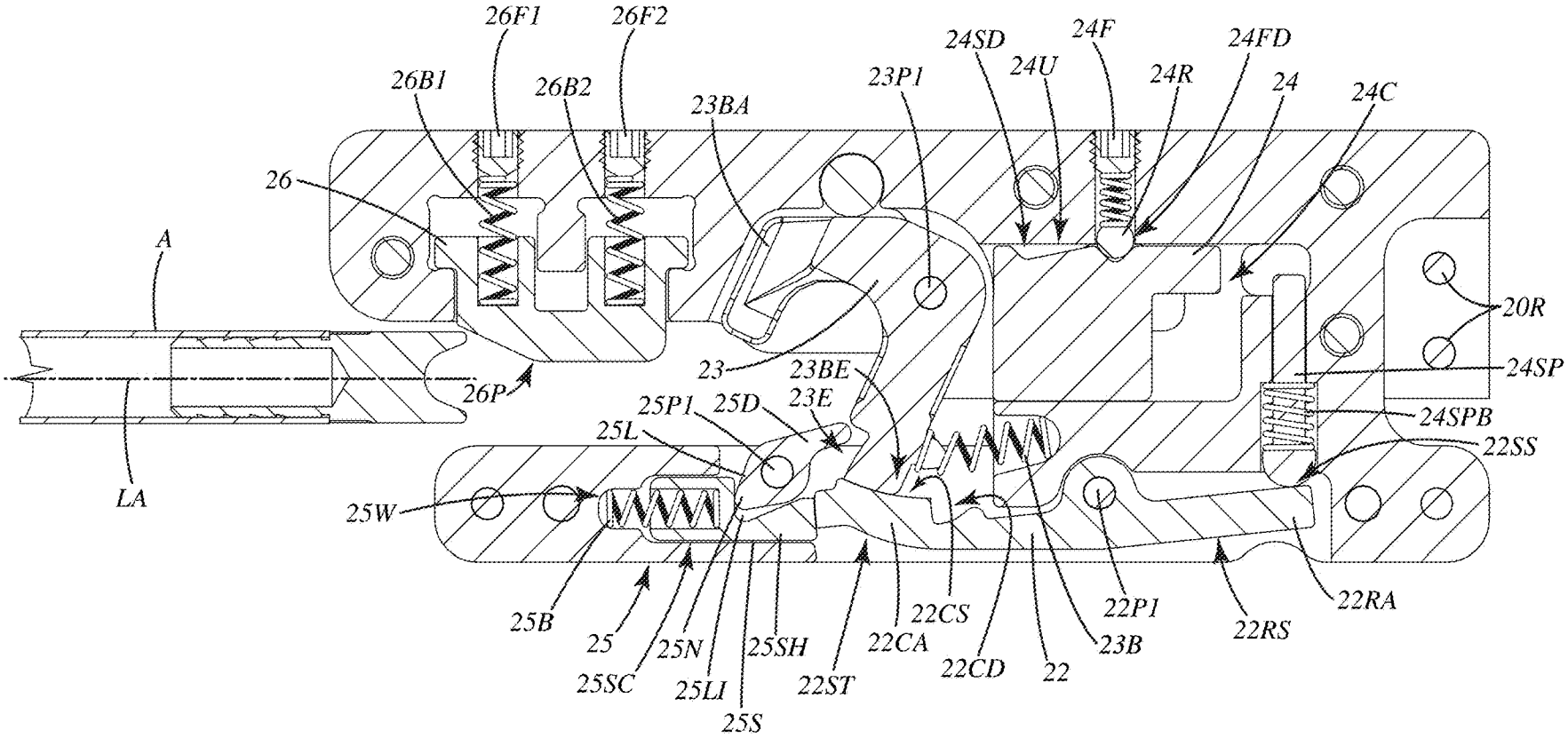
FIG. 6 is a section side view of a receiver including a safety and a bolt retention plunger in a retention mode to retain a bolt contacted along a linear contact tangent.
Figure 7:
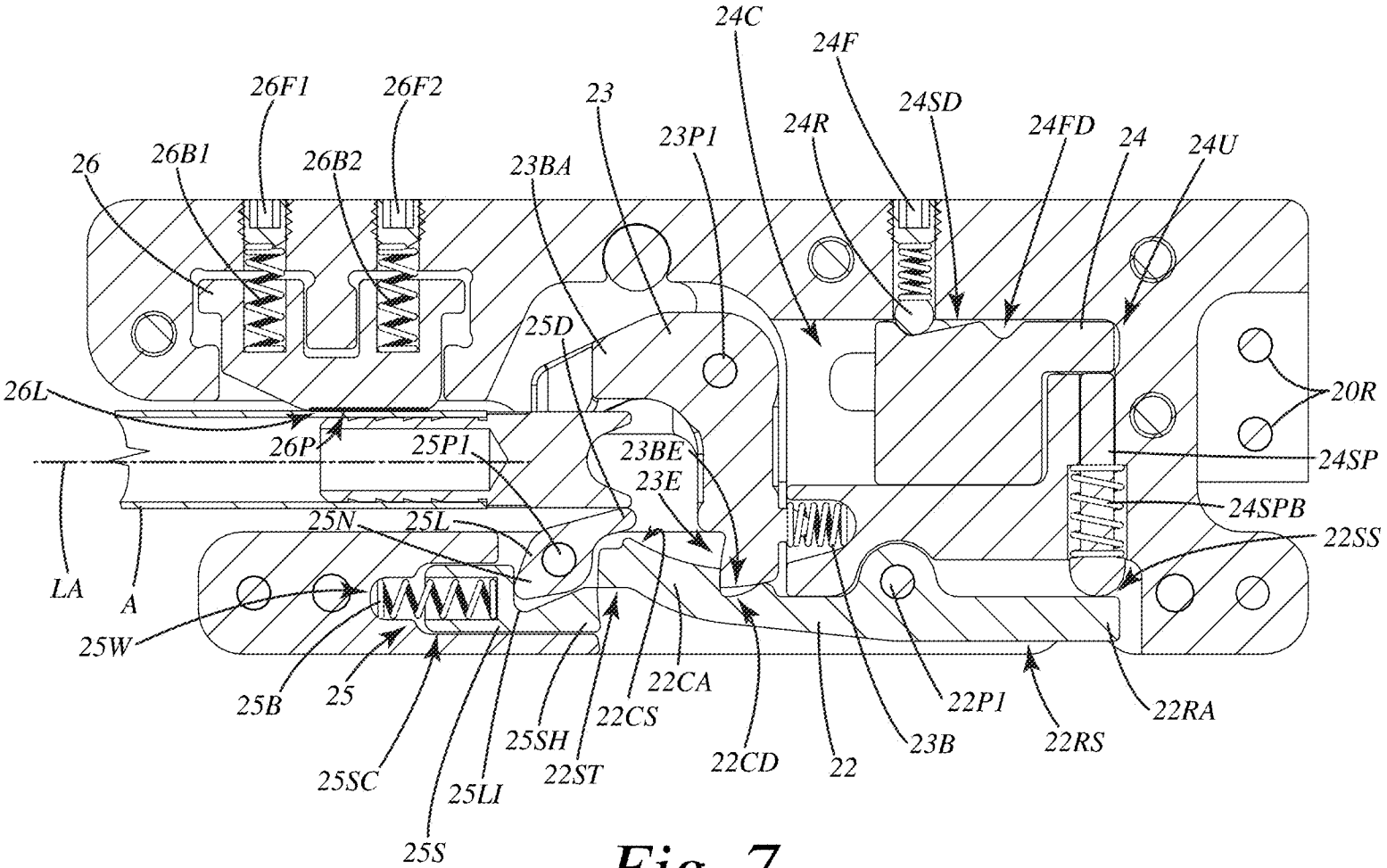
FIG. 7 is a section side view of a receiver including a safety and a bolt retention plunger in a neutral mode without a bolt.
Figure 8:
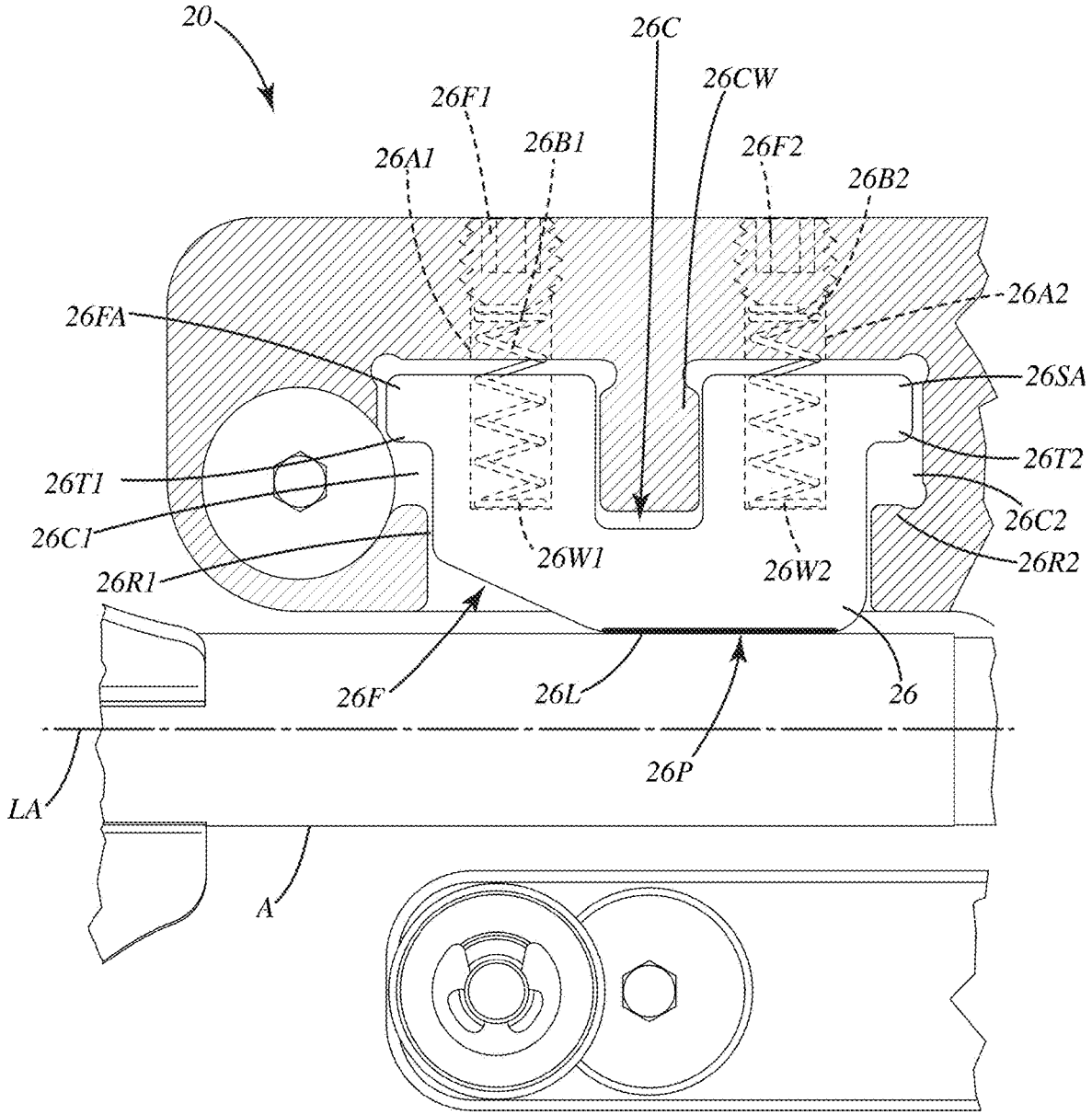
FIG. 8 is a close-up section side view of a receiver including a bolt retention plunger in a retention mode to retain a bolt contacted along a linear contact tangent.

The sear safety pin 24SP shown in FIGS. 6-7 can extend vertically to selectively interact with the safety 24 and the trigger assembly 21. The sear safety pin 24SP can move upward and downward in the sear safety pin slot depending on the movement of the sear 22 as described above. The upper end of the sear safety pin 24SP can be blocked to prevent or impair upward movement via its engagement with the lower surface of a safety bar or the safety 24 in general. For example, the rearward portion of the safety 24 can be in the position shown in FIG. 7 in which the safety 24 blocks movement of the sear safety pin 24SP and thus rotation of the sear 22 about the pin in a direction (i.e., counterclockwise). As a result, the trigger 21T cannot activate the sear 22 to release the catch 23. After the crossbow 10 has been fired, a restoring force of a safety pin biasing element 24SPB pushes down on a head of the sear safety pin 24SP, which in turn pushes downward on the sear 22 and restores the trigger assembly 21 to a pre-fired state.

The receiver 20 further includes a bolt retention plunger 26. The bolt retention plunger 26 can be disposed adjacent the catch 23 and can be joined with the receiver 20 above the rail 13. The bolt retention plunger 26 can be distal from and operably disconnected from the anti-dry fire system 25 and the safety 24. The bolt retention plunger 26 can be movable between a retention mode and a neutral mode. In the retention mode, depicted in FIGS. 7 and 8, the bolt retention plunger 26 can be operable to engage a bolt A disposed adjacent the rail 13 or capture the bolt A relative to the rail 13 and force the bolt against the rail 13. The bolt retention plunger 26 defines a planar surface 26P facing the rail 13. The planar surface 26P can be configured to contact a bolt A along a line of tangency 26L in the retention mode. The line of tangency 26L extends parallel to a longitudinal axis LA of the bolt A.

A first tunable fastener 26F1 can be disposed in a first aperture 26A1 defined by the receiver 20 above the bolt retention plunger 26. A second tunable fastener 26F2 can be disposed in a second aperture 26A2 defined by the receiver 20 above the bolt retention plunger 26. The first tunable fastener 26F1 can be a first threaded set screw and the second tunable fastener 26F2 can be a second threaded set screw. The second aperture 26A2 can be distal and rearward from the first aperture 26A1. Generally, the first aperture 26A1 and the second aperture 26A2 are disposed along an axis parallel the longitudinal axis of the bolt. A first biasing element 26B1 can be disposed between the first tunable fastener 26F1 and the bolt retention plunger 26, and a second biasing element 26B2 can be disposed between the second tunable fastener 26F2 and the bolt retention plunger 26. The first biasing element 26B1 and the second biasing element 26B2 can be a first compression spring (or a coil spring) and a second compression spring (or a coil spring), respectively. The first compression spring can be located below the first tunable fastener 26F1 and in a first well 26W1 defined by the bolt retention plunger 26. Correspondingly, the second compression spring can be located below the second tunable fastener and in a second well defined by the bolt retention plunger rearward of the first well.

The first tunable fastener 26F1 can be adjustable to exert a first force F1 on the first biasing element 26B1 such that the first force F1 can be transferred through the first biasing element 26B1 to the bolt retention plunger 26. The second tunable fastener 26F2 can be adjustable to exert a second force F2 on the second biasing element 26B2 such that the second force F2 can be transferred through the second biasing element 26B2 to the bolt retention plunger 26 distal and rearward from the first force F1. The tunability of the first tunable fastener 26F1 and the second tunable fastener 26F2 allow a user to tune a downward force on the bolt retention plunger 26 so the pressure of the bolt retention plunger 26 on the bolt A can be modified for the specific crossbow, bolt, and circumstance. The use of two distinct tunable fasteners allows for more acute control of the bolt retention plunger 26 and enables more responsive and tighter retention of the bolt engagement of the bolt disposed adjacent the rail 13. However, a single tunable fastener can be selected, although the use of a single tunable fastener might not have equivalent responsiveness and retention compared to embodiments with two or more tunable fasteners in some applications.

The first tunable fastener 26F1 and the second tunable fastener 26F2 can be tuned to various extents to increase or decrease the magnitude of the first force F1 or the second force F2, respectively. Generally, when the forces F1 and F2 are balanced, the bolt retention plunger 26 will be balanced, and, in the retention mode, will exert a uniform downward combined force PF on the bolt A. However, if the first tunable fastener 26F1 and the second tunable fastener 26F2 are tuned to different extents the forces F1 and F2 may be unbalanced, such that the downward combined force PF exerted on the bolt is uneven or non-uniform. If the first force F1 is greater than the second force F2, the combined force PF will act in a generally downward direction but would be uneven along the line of tangency 26L such that more force would be directly below the first tunable fastener 26F1 than elsewhere along the line of tangency 26L. If the second force F2 is greater than the first force F1, the combined force PF will act in a generally downward direction but would be uneven along the line of tangency 26L such that more force would be directly below the second tunable fastener 26F2 than elsewhere along the line of tangency 26L.

The bolt retention plunger 26 can include a first arm 26FA and a second arm 26SA. The first arm 26FA can include a first tab 26T1 and the second arm 26SA can include a second tab 26T2. The first arm can 26FA define a first well 26W1 and the second arm 26SA can define a second well 26W2. The bolt retention plunger 26 can be disposed within a plunger chamber 26C defined by the receiver 20. The plunger chamber 26C can be disposed on an upper portion of the receiver 20. The plunger chamber 26C extends to an opening that can be disposed over a bolt void that can be configured to receive the bolt A. The bolt void can be disposed immediately above the rail 13. The receiver 20 can include a chamber wall 26CW that bisects the plunger chamber 26C into a first arm chamber 26C1 and a second arm chamber 26C2. The receiver 20 can further include a first retaining step 26R1 and a second retaining step 26R2. The first arm 26FA can be disposed within the first arm chamber 26C1 and the second arm 26SA can be disposed within the second arm chamber 26C2. The first biasing element 26B1 can be disposed within the first well 26W1 and the second biasing element 26B2 can be disposed within the second well 26W2.

The planar surface 26P of the bolt retention plunger 26 can transition to a chamfered edge 26F or an angled forward ramp configured to engage the bolt when the bolt first engages the bolt retention plunger. This chamfered edge 26F eases the entry of the bolt A into the bolt void. The planar surface 26P may engage the line of tangency 26L of the bolt A along a portion of the bolt A having a length of optionally 1 mm to 30 mm, inclusive, 5 mm to 25 mm, inclusive, 10 mm to 25 mm, inclusive, 10 mm to 20 mm, inclusive, or other lengths depending on the application. The linear contact 26L between the planar surface 26P and the bolt A has the benefit of creating an even distribution of force over the length of the portion of the bolt A contacted by the bolt retention plunger 26, with limited to no sideways component to the force vector resulting in a pure or essentially pure downward force retaining the bolt A against the rail 13. Additionally, the linear contact 26L reduces uneven wear, allowing for increased use lifetimes of the linear bolt plunger and the receiver 20.

Figure 9:
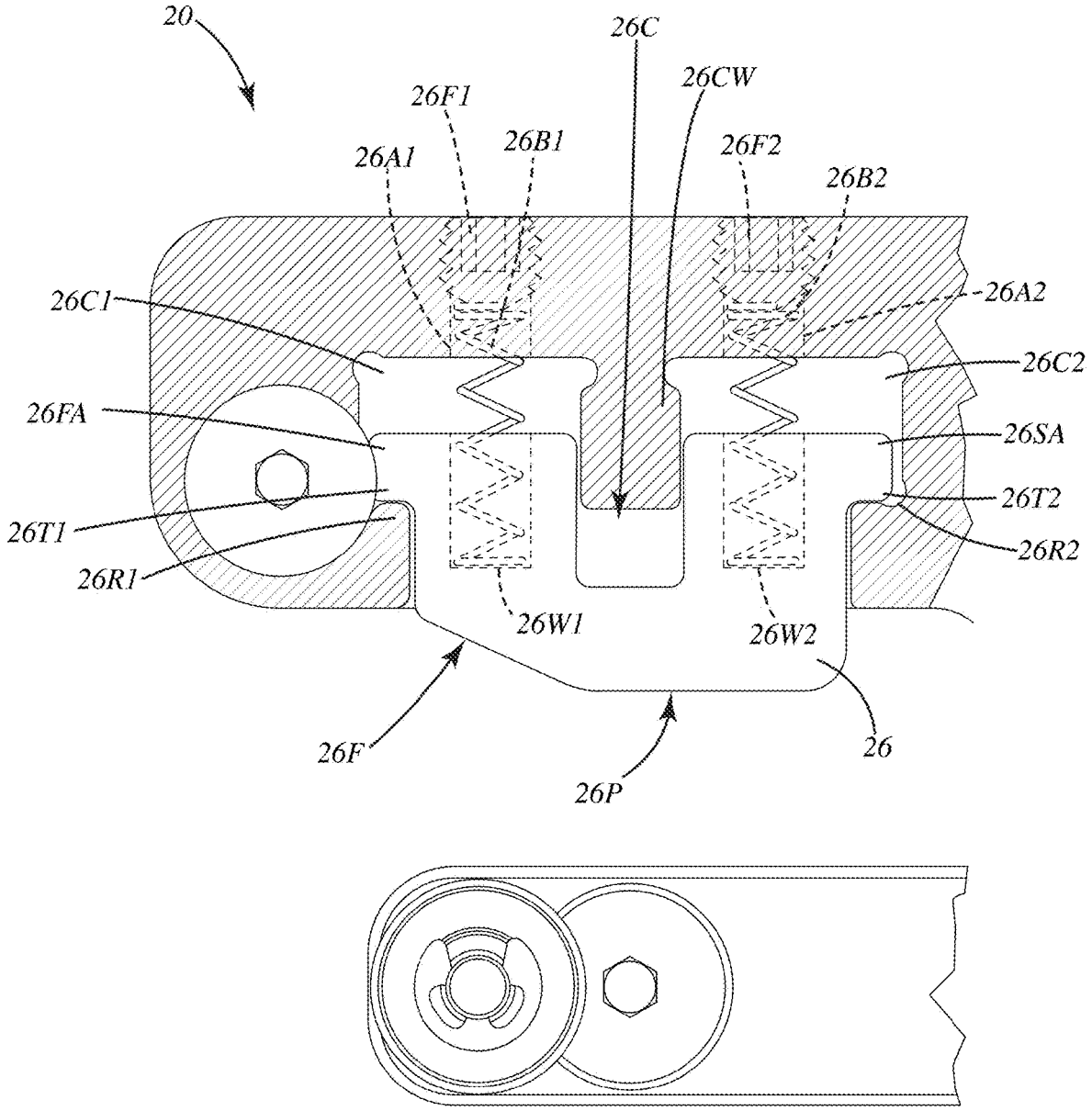
FIG. 9 is a close-up section side view of a receiver including a bolt retention plunger in a neutral mode without a bolt.

In the neutral mode, depicted in FIGS. 6 and 9, the first tab 26T1 and the second tab 26T2 contact the first retaining step 26R1 and the second retaining step 26R2 such that the bolt retention plunger 26 can be retained within the plunger chamber 26C. The bolt retention plunger 26 can be held between a combined force PF exerted by the first and second biasing elements pushing against the first and second retaining steps. The bolt retention plunger 26 can be configured to be biased farther into the plunger chamber 26C when the bolt A can be placed in the bolt void. The bolt A contacts and upwardly displaces the bolt retention plunger 26 into the retention mode. The removal of the bolt A (i.e., firing the crossbow) removes an upward force displacing the bolt retention plunger 26, and the first and second forces supplied by the first and second biasing elements, respectively, restore the bolt retention plunger 26 to the neutral mode.

As depicted in FIG. 4, the rail 13 can balance the combined force PF of the first force F1 and the second force F2 with a corresponding first rail force RF1 and second rail force RF2. The first rail force RF1 can be exerted along a first rail line of tangency 13L1 where one side of the rail 13 contacts the bolt A. The second rail force RF2 can be exerted along a second rail line of tangency 13L2 where another side of the rail 13 contacts the bolt A. The first rail line of tangency 13L1, the second rail line of tangency 13L2, and the line of tangency 26L of the bolt retention plunger 26 can be equally spaced about the surface of the bolt A. Generally, each of the first rail line of tangency 13L1, the second rail line of tangency 13L2, and the line of tangency 26L of the bolt retention plunger 26 will be spaced about a circumference of bolt A separated by 120°. The first rail force RF1, the second rail force RF2, and the combined force FOR can be evenly distributed about the bolt A, balancing all the forces acting on the bolt A. The bolt A can thereby be stabilized proximate or contacting the rail 13.

Although the different elements and assemblies of the embodiments are described herein as having certain functional characteristics, each element and/or its relation to other elements can be depicted or oriented in a variety of different aesthetic configurations, which support the ornamental and aesthetic aspects of the same. Simply because an apparatus, element or assembly of one or more of elements is described herein as having a function does not mean its orientation, layout or configuration is not purely aesthetic and/ornamental in nature.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to" another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, any combination of X, Y and Z, for example, X, Y, Z; X, Y; X, Z; Y, Z, and/or any other possible combination together or alone of those elements, noting that the same is open ended and can include other elements.

Reference throughout this specification to "a current embodiment" or "an embodiment" or "alternative embodiment" means that a particular feature, structure, or characteristic described in connection with the embodiment is included in at least one embodiment herein. Accordingly, the appearance of the phrases "in one embodiment" or "in an embodiment" or "in an alternative embodiment" in various places throughout this specification are not necessarily all referring to the same embodiment. Furthermore, the particular features, structures, or characteristics may be combined in any suitable manner in one or more embodiments.

What is claimed is:

1. A crossbow comprising:

a first limb and an opposing second limb;

a bowstring extending between the first limb and the second limb;

a frame joined with the first limb and the second limb and including a rail, the bowstring extending transverse to the frame and moveable between an undrawn more and a drawn mode;

a receiver joined with the frame, the receiver including a catch configured to maintain the bowstring in the drawn mode;

a bolt retention plunger disposed adjacent the bowstring catch, the bolt retention plunger being movable between a retention mode and a neutral mode, the bolt retention plunger operable in the retention mode to engage a bolt disposed adjacent the rail, the bolt retention plunger defining a planar surface facing the rail, the planar surface configured to contact the bolt along a line of tangency in the retention mode, the line of tangency extending parallel to a longitudinal axis of the bolt;

a first tunable fastener disposed in a first aperture defined by the receiver;

a second tunable fastener disposed in a second aperture defined by the receiver, the second aperture being distal and rearward from the first aperture;

a first biasing element disposed between the first tunable fastener and the bolt retention plunger; and a second biasing element disposed between the second tunable fastener and the bolt retention plunger, wherein the first tunable fastener is adjustable to exert a first force on the first biasing element such that the first force is transferred through the first biasing element to the bolt retention plunger, wherein the second tunable fastener is adjustable to exert a second force on the second biasing element such that the second force is transferred through the second biasing element to the bolt retention plunger distal and rearward from the first force.

2. The crossbow of claim 1, wherein the first tunable fastener is a first threaded set screw and the second tunable fastener is a second threaded set screw.

3. The crossbow of claim 1, wherein the first biasing element is a first compression spring, the first compression spring being located below the first tunable fastener and in a first well defined by the bolt retention plunger, wherein the second biasing element is a second compression spring, the second compression spring being located below the second tunable fastener and in a second well defined by the bolt retention plunger rearward of the first well.

4. The crossbow of claim 1, wherein the receiver is movable along the frame from a first position adjacent the first limb and the second limb in the undrawn mode to a second position distal from the first limb and the second limb in the drawn mode.

5. The crossbow of claim 1, wherein the receiver is stationary and fixed relative to the frame.

6. The crossbow of claim 1, wherein the bolt retention plunger is disposed within a plunger chamber defined by the receiver, wherein the plunger chamber extends to an opening that is disposed over a bolt void that is configured to receive the bolt, wherein the bolt retention plunger is configured to be biased farther into the plunger chamber when the bolt is placed in the bolt void.

7. The crossbow of claim 6, wherein the bolt retention plunger includes a first arm and a second arm, the first arm including a first tab and the second arm including a second tab;

wherein the receiver includes a chamber wall that bisects the plunger chamber into a first arm chamber and a second arm chamber, and a first retaining step and a second retaining step;

wherein the first arm is disposed within the first arm chamber and the second arm is disposed within the second arm chamber; and wherein the first tab and the second tab are operable in the neutral mode to contact the first retaining step and the second retaining step such that the bolt retention plunger is retained within the plunger chamber.

8. The crossbow of claim 7, wherein the first arm defines a first well and the second arm defines a second well; and wherein the first biasing element is disposed within the first well and the second biasing element is disposed within the second well.

9. The crossbow of claim 1, wherein the bolt retention plunger defines a chamfered edge.

10. The crossbow of claim 1, comprising:

a safety extending in the receiver; and an anti-dry fire element movably disposed in the receiver, wherein the bolt retention plunger is separately operable from and distal from the anti-dry fire element and the safety.

11. A crossbow comprising:

a first limb and an opposing second limb;

a bowstring extending between the first limb and the second limb;

a frame joined with the first limb and the second limb and including a rail, the bowstring extending transverse to the frame and moveable between an undrawn mode and a drawn mode;

a receiver joined with the frame, the receiver including a catch configured to maintain the bow string in the drawn mode;

a bolt retention plunger joined with the receiver above the rail, the bolt retention plunger being movable between a retention mode and a neutral mode, the bolt retention plunger operable in the retention mode to engage a bolt disposed adjacent the rail, the bolt retention plunger defining a planar surface facing the rail, the planar surface configured to contact the bolt along a line of tangency in the retention mode, the line of tangency extending parallel to a longitudinal axis of the bolt;

an anti-dry fire element movably joined with the receiver, the anti-dry fire element being distal from and operably disconnected from the bolt retention plunger.

12. The crossbow of claim 11, wherein the receiver includes:

a first tunable fastener disposed in a first aperture defined by the receiver; and a first biasing element disposed between the first tunable fastener and the bolt retention plunger, and wherein the first tunable fastener is adjustable to exert a first force on the first biasing element against pressure such that the first force is transferred through the first biasing element to the bolt retention plunger.

13. The crossbow of claim 12,
wherein the first tunable fastener is a first threaded set screw,
wherein the first biasing element is a coil spring,
wherein the coil spring is disposed in a first well defined by the bolt retention plunger,
wherein the planar surface transitions to an angled forward ramp that is configured to first engage the bolt when the bolt engages the bolt retention plunger,
wherein the planar surface engages the line of tangency along a portion of the bolt, the portion of the bolt having a length of 1 mm to 30 mm, inclusive,
wherein the bolt has a diameter,
wherein the length is greater than the diameter.

14. The crossbow of claim 11,
wherein the receiver is movable along the frame from a first position adjacent the first limb and the second limb in the undrawn mode to a second position distal from the first limb and the second limb in the drawn mode.

15. The crossbow of claim 11,
wherein the receiver is stationary and fixed relative to the frame.

16. The crossbow of claim 11,
wherein the bolt retention plunger is disposed within a plunger chamber defined by the receiver,
wherein the plunger chamber extends to an opening that is disposed over a bolt void that is configured to receive the bolt,
wherein the bolt retention plunger is configured to be biased farther into the plunger chamber when the bolt is placed in the bolt void;
wherein the bolt plunger includes a first arm and a second arm, the first arm including a first tab and the second arm including a second tab;
wherein the receiver includes:
a chamber wall that bisects the plunger chamber into a first arm chamber and a second arm chamber, and
a first retaining step and a second retaining step;
wherein the first arm is disposed within the first arm chamber and the second arm is disposed within the second arm chamber; and
wherein the first tab and the second tab are operable in the neutral mode to contact the first retaining step and the second retaining step such that the bolt retention plunger is retained within the plunger chamber.

17. A crossbow comprising:
a first limb and an opposing second limb;
a bowstring extending between the first limb and the second limb;
a frame joined with the first limb and the second limb and including a rail, the bowstring extending transverse to the frame and moveable between an undrawn mode and a drawn mode;
a receiver joined with the frame, the receiver including a catch configured to maintain the bowstring in the drawn mode; and
a bolt retention plunger operable in a retention mode to engage a bolt disposed adjacent the rail, thereby capturing the bolt relative to the rail and forcing the bolt against the rail,
wherein the bolt retention plunger defines a planar surface facing the rail configured to engage the bolt along a line of tangency of the bolt in the retention mode,
wherein the bolt retention plunger is biased against the bolt in the retention mode by at least two biasing elements distal from one another.

18. The crossbow of claim 17 comprising:
a first tunable fastener disposed in a first aperture defined by the receiver;
a second tunable fastener disposed in a second aperture defined by the receiver, the second aperture being distal and rearward from the first aperture;
a first biasing element disposed between the first tunable fastener and the bolt retention plunger, the first biasing element being one of the at least two biasing elements;
a second biasing element disposed between the second tunable fastener and the bolt retention plunger, the second biasing element being another of the at least two biasing elements,
wherein the first tunable fastener is adjustable to exert a first force on the first biasing element such that the first force is transferred through the first biasing element to the bolt retention plunger,
wherein the second tunable fastener is adjustable to exert a second force, different from the first force, on the second biasing element such that the second force is transferred through the second biasing element to the bolt retention plunger distal and rearward from the first force.

19. The crossbow of claim 18,
wherein the first tunable fastener is a first threaded set screw and the second tunable fastener is a second threaded set screw,
wherein the first biasing element is a first compression spring, the first compression spring being located below the first tunable fastener and in a first well defined by the bolt retention plunger,
wherein the second biasing element is a second compression spring, the second compression spring being located below the second tunable fastener and in a second well defined by the bolt retention plunger rearward of the first well.

20. The crossbow of claim 17,
wherein the bolt retention plunger is disposed within a plunger chamber defined by the receiver,
wherein the plunger chamber extends to an opening that is disposed over a bolt void that is configured to receive the bolt,
wherein the bolt retention plunger is configured to be biased farther into the plunger chamber when the bolt is placed in the bolt void;
wherein the bolt plunger includes a first arm and a second arm, the first arm including a first tab and the second arm including a second tab;
wherein the receiver includes:
a chamber wall that bisects the plunger chamber into a first arm chamber and a second arm chamber, and
a first retaining step and a second retaining step;
wherein the first arm is disposed within the first arm chamber and the second arm is disposed within the second arm chamber; and
wherein the first tab and the second tab are operable in the neutral mode to contact the first retaining step and the second retaining step such that the bolt retention plunger is retained within the plunger chamber.

* * * * *